US007635201B2

(12) United States Patent
Deng

(10) Patent No.: US 7,635,201 B2
(45) Date of Patent: Dec. 22, 2009

(54) LAMP BAR HAVING MULTIPLE LED LIGHT SOURCES

(76) Inventor: Jia H. Deng, 4615 State St., Montclair, CA (US) 91763

( * ) Notice: Subject to any disclaimer, the term of this patent is extended or adjusted under 35 U.S.C. 154(b) by 0 days.

(21) Appl. No.: 11/897,243

(22) Filed: Aug. 28, 2007

(65) Prior Publication Data

US 2008/0055894 A1 Mar. 6, 2008

Related U.S. Application Data

(60) Provisional application No. 60/840,902, filed on Aug. 28, 2006.

(51) Int. Cl.
*F21V 21/00* (2006.01)

(52) U.S. Cl. ..... 362/249.02; 362/217.01; 362/240

(58) Field of Classification Search ..... 362/240, 362/800, 217–225, 362, 555, 545, 249, 648
See application file for complete search history.

(56) References Cited

U.S. PATENT DOCUMENTS 4,271,458 A * 6/1981 George, Jr. ..... 362/236
5,099,401 A * 3/1992 Kondo et al. ..... 362/541
5,103,382 A * 4/1992 Kondo et al. ..... 362/503
5,343,375 A * 8/1994 Gross et al. ..... 362/248
5,410,453 A * 4/1995 Ruskouski ..... 362/20
5,651,636 A * 7/1997 Yeh ..... 404/9
6,157,117 A * 12/2000 Taylor ..... 313/318.01
6,283,612 B1 * 9/2001 Hunter ..... 362/240
6,305,109 B1 * 10/2001 Lee ..... 40/546
6,361,186 B1 * 3/2002 Slayden ..... 362/249
6,472,823 B2 * 10/2002 Yen ..... 315/112
6,583,550 B2 * 6/2003 Iwasa et al. ..... 313/485
6,585,393 B1 * 7/2003 Brandes et al. ..... 362/249
6,609,813 B1 * 8/2003 Showers et al. ..... 362/240
6,612,717 B2 * 9/2003 Yen ..... 362/245
6,641,294 B2 * 11/2003 Lefebvre ..... 362/544
6,682,205 B2 * 1/2004 Lin ..... 362/249
6,853,151 B2 * 2/2005 Leong et al. ..... 315/185 R
6,874,924 B1 * 4/2005 Hulse et al. ..... 362/551
6,882,111 B2 * 4/2005 Kan et al. ..... 315/122
6,997,576 B1 * 2/2006 Lodhie et al. ..... 362/240
7,048,413 B2 * 5/2006 Fan ..... 362/249
7,049,761 B2 * 5/2006 Timmermans et al. ..... 315/246
7,052,171 B1 * 5/2006 Lefebvre et al. ..... 362/649
7,114,830 B2 * 10/2006 Robertson et al. ..... 362/240
7,114,834 B2 * 10/2006 Rivas et al. ..... 362/373
7,210,818 B2 * 5/2007 Luk et al. ..... 362/252
7,249,865 B2 * 7/2007 Robertson ..... 362/228
7,307,391 B2 12/2007 Shan
7,311,423 B2 * 12/2007 Frecska et al. ..... 362/372
7,441,922 B2 * 10/2008 Huang et al. ..... 362/235
2006/0146531 A1 * 7/2006 Reo et al. ..... 362/244

* cited by examiner

*Primary Examiner*—Gunyoung T Lee
(74) *Attorney, Agent, or Firm*—FSP LLC

(57) ABSTRACT

A lamp bar may include and/or involve multiple LED light sources linearly arranged along a length of the lamp bar.

3 Claims, 6 Drawing Sheets

LAMP BAR HAVING MULTIPLE LED LIGHT SOURCES

TECHNICAL FIELD

The present disclosure relates to LED (light emitting diode) lighting.

BACKGROUND

Conventional fluorescent lighting has been popular due largely to lower overall cost as compared to owning and operating filament lighting sources. However, fluorescent lights need a ballast to operate, which causes inefficiencies in operation. Fluorescent lighting may require periodic maintenance and replacement, and may incur costs upon disposal. Furthermore, fluorescent lights have a lower life expectancy than LED light sources. Fluorescent lights may emit ultraviolet rays which may cause colors to fade and food to spoil sooner. Fluorescents lights may contain mercury, which causes pollution. Fluorescent lights may break easily and may thus be difficult to transport. Fluorescent lights operate at high voltage and frequencies, which may cause interference with sensitive electronics.

A large infrastructure exists within dealerships, offices, and even homes to support fluorescent lighting. It would be advantageous to bring the benefits of LED lighting, including lower overall costs (energy usage, maintenance, replacement and disposal) to the existing fluorescent infrastructure.

SUMMARY

The following summary is intended to highlight and introduce some aspects of the disclosed embodiments, but not to limit the scope of the claims. Thereafter, a detailed description of illustrated embodiments is presented, which will permit one skilled in the relevant art to make and use various embodiments.

A lamp bar may include and/or involve multiple LED light sources linearly arranged along a length of the lamp bar. The LED light sources may be arranged at regular intervals along the length of the lamp bar, and/or arranged at cutouts along the length of the lamp bar. An aluminum lamp bar may be formed with an outside diameter of 0.5 inch to 1.5 inch and the dimensions of T12, T8 and T5 fluorescent linear tube profile aluminum extrusions.

One or more of the LED light sources may be attached to a moveable base formed to slide within a channel formed in an upper half of the lamp bar. A similar base may be formed to slide within a channel formed in a lower half of the lamp bar, and further formed to accept a bolt descending from the upper half to the lower half, the upper and lower halves fitting together to form a lip so that tightening the bolt urges the moveable base against the lip thus urging the lower half against the upper half.

The lamp bar may be formed from a single extruded part forming slots to retain circuit boards to which the LED light sources are soldered, for example on an aluminum printed circuit board. The single extruded part may further form slots to retain one or more snap-in LED light sources soldered to the aluminum printed circuit board.

The lamp bar may include and/or involve upper and lower extruded parts formed to fit together.

Each LED light source may include a soldered aluminum PC board, the LED light sources linked with wiring, each coupled to its own moveable base within the light bar.

The LED lamp bar may interface to an LED driver in the lamp fixture. The ballast in an existing fluorescent fixture may be removed and replaced with an LED driver, so that the LED lamp bar may be interfaced to the fixture using the same pin connectors as the fluorescent lamp it replaced.

The lamp bar may have linear, circular, compact, or U shaped profiles and may interface to fixtures designed for fluorescent lights of these same profiles.

An aluminum LED bar may have the same length as a linear tube of fluorescent light, for example from 11.5 to 96 inches long, and an outer diameter of T12, T8 and T5.

Other system/method/apparatus aspects are described in the text (e.g., detailed description and claims) and drawings forming the present application.

BRIEF DESCRIPTION OF THE DRAWINGS

In the drawings, the same reference numbers and acronyms identify elements or acts with the same or similar functionality for ease of understanding and convenience. To easily identify the discussion of any particular element or act, the most significant digit or digits in a reference number refer to the figure number in which that element is first introduced.

DETAILED DESCRIPTION

References to "one embodiment" or "an embodiment" do not necessarily refer to the same embodiment, although they may.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to."Words using the singular or plural number also include the plural or singular number respectively. Additionally, the words "herein," "above," "below" and words of similar import, when used in this application, refer to this application as a whole and not to any particular portions of this application. When the claims use the word "or" in reference to a list of two or more items, that word covers all of the following interpretations of the word: any of the items in the list, all of the items in the list and any combination of the items in the list.

Double Extrusion Lamp Bar

Figure 1A:
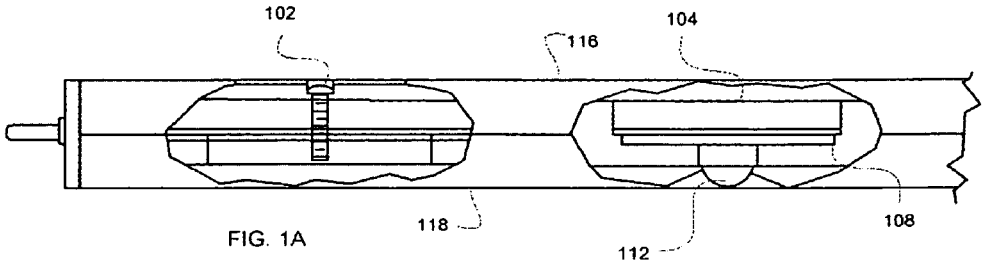
FIG. 1 is an illustration of an embodiment of a lamp bar.
Figure 1B:
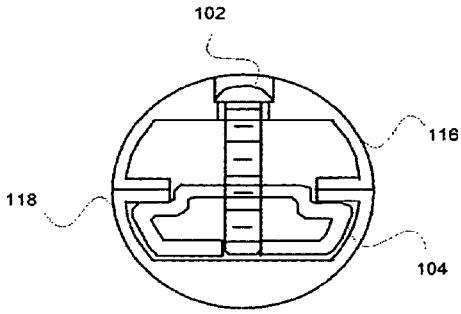
Figure 1C:
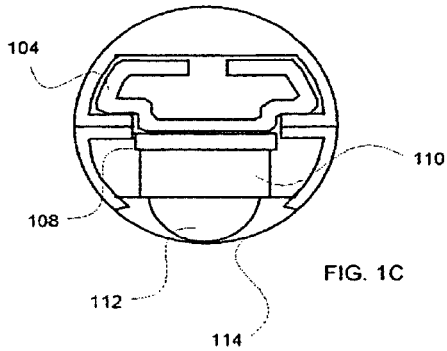

FIG. 1 is an illustration of an embodiment of a lamp bar.

The LED lamp bar comprises two extrusions 116 and 118, an upper extrusion 116 and a lower extrusion 118. The upper and lower extrusions 116 and 118 are formed to fit together to form a lip so that tightening a bolt or screw 102 urges the moveable base against the lip thus urging the lower extrusion 118 against the upper extrusion 116.

The extrusions 116 and 118 are held together by bolts 102. The lower extrusion 118 is formed to receive a moveable base 104. The bolts 102 retain to the moveable base 104. The upper extrusion 116 may receive a similar moveable base 104, which may retain the soldered LED aluminum circuit board 108, to which an LED base 110 is attached, which the LED 112 fits into. The top and bottom extrusions 116 and 118 may be secured at the ends by an end cap 114, or the two extrusions may snap together. The LED lamp bar may contain several LED assemblies (LED 112, LED base 110, Aluminum circuit board for mount LED 108, and base 104), which may be linearly and possibly regularly (e.g. every foot) spaced along its length.

Electronic driver circuitry may replace the ballast in a fluorescent fixture to enable the LED bar to be plugged in in place of a fluorescent light.

A T8 (e.g. from 12 inch to 96 inch long by one inch diameter) profile aluminum extrusion may be used in some cases; in other cases a T5 (e.g. from 11.5 to 55 inch long by ⅝ inch diameter) profile aluminum extrusion may be employed; and yet other profiles may also be used.

For example, the bar may be a "T12" having a 1.5 inch outer diameter, and various lengths including but not limited to 12, 24, 36, 48, and 96 inches.

Lamp Bar with Cutouts

Figures 2A, 2B:
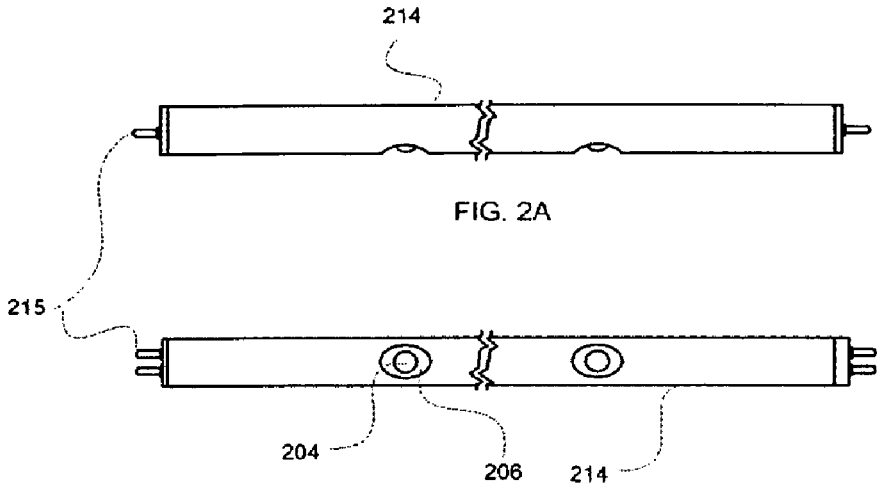
FIG. 2 is an illustration of an embodiment of a lamp bar with cutouts.

FIG. 2 is an illustration of another embodiment of a lamp bar.

The multiple LED light sources 204 may be arranged linearly at cutouts 206 along the length of the lamp bar 214. The cutouts 206 may enable the LED lamp bar user to change the LED source 204 when necessary without disassembling the light bar 214.

In some embodiments, a single cutout comprising substantially all of the lower extrusion may be employed, instead of discrete cutouts 206.

The aluminum lamp bar may have the same end pin interface 215 as fluorescent lamps, for example pins having an outer diameter of 0.1 inch to 0.2 inch. The pins may have a center-to-center distance compatible with "Miniature Bipin" (e.g. T5 with 0.15 inch to 0.23 inch), or "Bipin" (e.g. T8 and T12 with 0.39 inch to 0.5 inch).

The LED lamp bar may comprise electronic circuitry and hardware fittings such that it may be plugged into a fluorescent bulb lamp in place of a fluorescent light.

Single Extrusion Lamp Bar

Figure 3A:
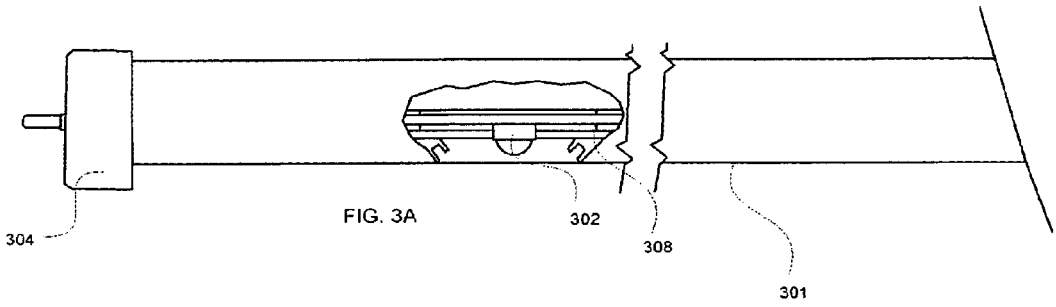
FIG. 3 is an illustration of yet another embodiment of a lamp bar.
Figure 3B:
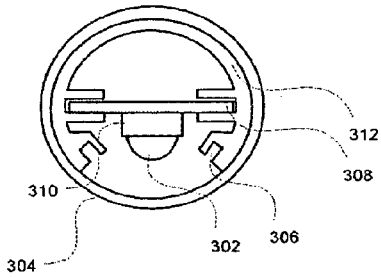

FIG. 3 is an illustration of another embodiment of a lamp bar.

The LED lamp bar 301 comprises a single extrusion 312 to which end caps 304 may be secured. The lamp bar 301 may comprise several LED light sources 302, which may be regularly spaced along the length of the lamp bar. Each LED source 302 may plug into an LED holder 310, which is coupled to a drive circuit board 308. The end-caps 301 may comprise circuitry and fittings to enable the lamp bar 301 to be plugged into a fluorescent bulb lamp in place of a fluorescent light.

The extrusion 312 may be shaped to form slots to retain the boards 308 to which the LED sources are mounted. The extrusion may also be formed to form slots 306 to retain a snap-in cover. The cover may be made of glass or plastic which is transparent or semi-transparent.

Other Embodiments of a Lamp Bar

Figure 4:
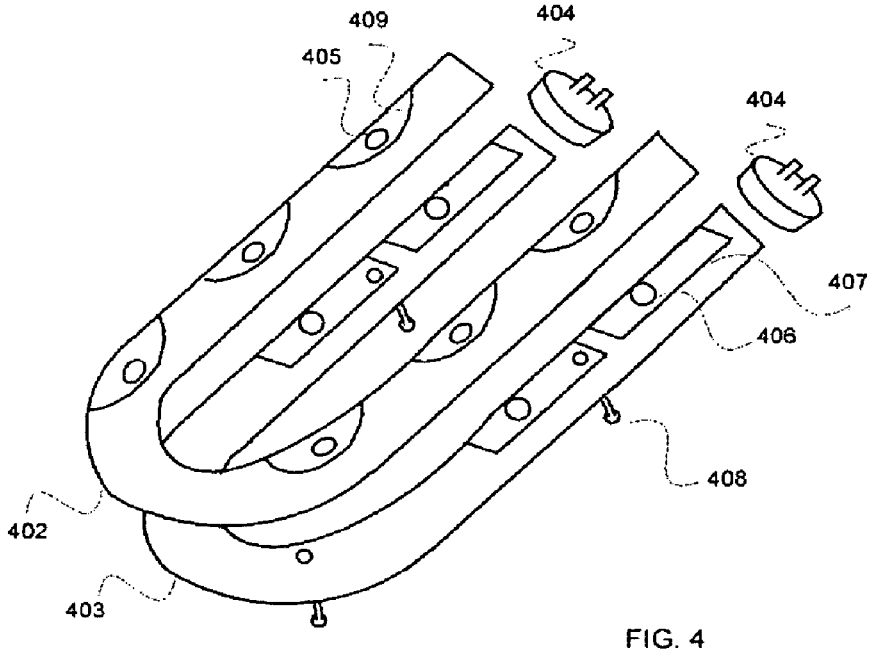
FIG. 4 is an illustration of an embodiment of a "U" shaped lamp bar.

FIG. 4 is an illustration of an embodiment of a "U" shaped aluminum lamp bar. In one embodiment the U bar has an end to center distance of six inches.

The lamp bar comprises two parts 402 and 403 which may be joined using screws 408 or other fasteners. An electrical interface 404 is provided at both ends of the lamp bar, for example Bipin or Miniature Bipin end contact connectors. The electrical interface 404 may be electrically and mechanically compliant with similar interfaces for fluorescent lighting. The part 405 may comprise holes 405 through which strategically located LED components 406 may protrude, and having surrounding cutouts 409 to enable dispersal of the LED light. Each LED component 406 may have drive/control circuitry 407 co-located along the bar with the LED component 406.

The lamp bar may in some embodiments be a "T8" having a one inch outer diameter, or a "T12" having a 1.5 inch outer diameter.

Figure 5:
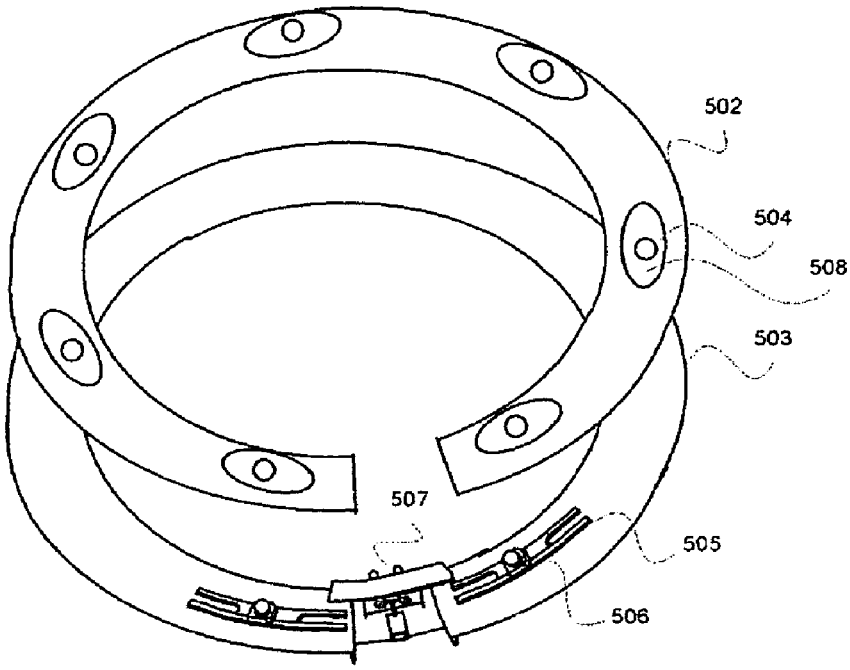
FIG. 5 is an illustration of a circular lamp bar.

FIG. 5 is an illustration of a circular lamp bar. In some embodiments the circular bar has an outside diameter of one inch to 1.18 inch (e.g. T9 tube). The circular lamp may comprise two parts 502 and 503, joined by screws or other mechanisms (not shown). The circumference of the part 502 may comprise holes 504 through which LED elements 506 of the part 503 may protrude. Cutouts 508 in the part may enable dispersal of light from the LED elements 506. Each LED element 506 may comprise mounting apparatus and driver/control circuitry 505 co-located with the LED element 506 along the circumference of the part 503. The bar may have a pin interface having pins with an outside diameter of 0.08 inch to 0.12, and made of copper or brass. The pin layout may be rectangular with the a center to center distance of 0.2 inch by 0.24 inch (e.g. G10q base) 507.

The lamp bar may in some embodiments provide between 22 watts and 32 watts, similar to a "T9" circular fluorescent light. In some embodiments, the circular bar may have an outer diameter from 8 inches to 20 inches.

Figure 6:
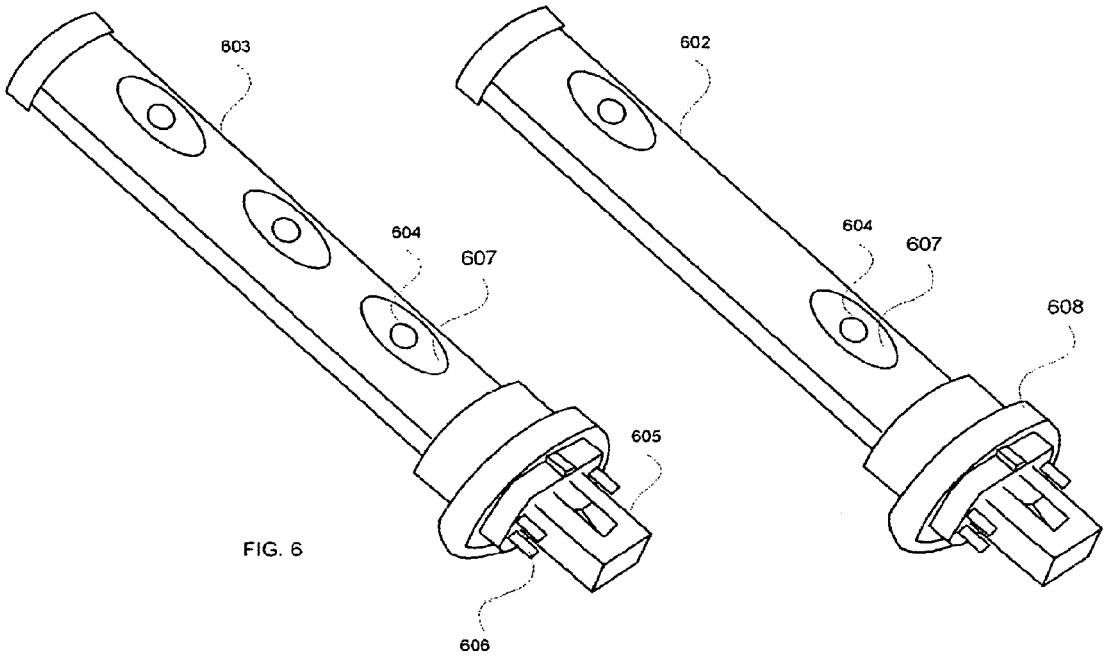
FIG. 6 is an illustration of two embodiments of a compact lamp bar.

FIG. 6 is an illustration of two embodiments of a compact lamp bar. One embodiment 602 comprises two LED elements, the other embodiment 603 comprises three LED elements. Each LED element may protrude through holes 604 in the lamp bar, and each hole may have a cutout 607 to disperse light from the LED.

A base 608 is provided to allow the lamp to rotate in a fixture to which it is mounted. The base 608 may comprise four pin contacts 606 and may have a tongue 605 for insertion into the fixture. The base 608 may, in some embodiments, be a 340 rotary base capable of rotation through approximately 340 degrees of angle. The base 608 may, in some embodiments, be GX23 or GX24, or other compact fluorescent lamps compatible profile.

What is claimed is:

1. A lamp bar comprising:

multiple light emitting diode (LED) light sources linearly arranged along a length of the lamp bar;

each LED light source attached to a first moveable base formed to slide within a channel formed in an upper half of the lamp bar;

a second moveable base also formed to slide within a channel formed in a lower half of the lamp bar, and further formed to accept a bolt descending from the upper half to the lower half, the upper and lower halves fitting together to form a lip so that tightening the bolt urges the second moveable base against the lip thus urging the lower half against the upper half.

2. A U-shaped lamp bar comprising:

multiple light emitting diode (LED) light sources linearly arranged along a length of the lamp bar;

each LED light source attached to a first moveable base formed to slide within a channel formed in an upper half of the lamp bar;

a second moveable base also formed to slide within a channel formed in a lower half of the lamp bar, and further formed to accept a bolt descending from the upper half to the lower half, the upper and lower halves fitting together to form a lip so that tightening the bolt urges the second moveable base against the lip thus urging the lower half against the upper half.

3. A substantially circular lamp bar comprising:

multiple light emitting diode (LED) light sources linearly arranged along a length of the lamp bar;

each LED light source attached to a first moveable base formed to slide within a channel formed in an upper half of the lamp bar;

a second moveable base also formed to slide within a channel formed in a lower half of the lamp bar, and further formed to accept a bolt descending from the upper half to the lower half, the upper and lower halves fitting together to form a lip so that tightening the bolt urges the second moveable base against the lip thus urging the lower half against the upper half.

* * * * *